US011123741B2

(12) United States Patent
McPhee et al.

(10) Patent No.: US 11,123,741 B2
(45) Date of Patent: Sep. 21, 2021

(54) DISCHARGE END WALL SYSTEM

(71) Applicant: Polycorp Ltd., Elora (CA)

(72) Inventors: Robert Michael McPhee, Burlington (CA); Pramod Kumar, Waterloo (CA)

(73) Assignee: Polycorp Ltd., Elora (CA)

( * ) Notice: Subject to any disclaimer, the term of this patent is extended or adjusted under 35 U.S.C. 154(b) by 294 days.

(21) Appl. No.: 16/453,439

(22) Filed: Jun. 26, 2019

(65) Prior Publication Data

US 2019/0388900 A1 Dec. 26, 2019

Related U.S. Application Data

(60) Provisional application No. 62/689,884, filed on Jun. 26, 2018.

(51) Int. Cl.

| | |
|---|---|
| ***B02C 13/10*** | (2006.01) |
| ***B02C 13/282*** | (2006.01) |
| ***B02C 13/286*** | (2006.01) |

(52) U.S. Cl.

CPC ..... *B02C 13/282* (2013.01); *B02C 13/10* (2013.01); *B02C 13/286* (2013.01); *B02C 2013/28609* (2013.01); *B02C 2210/02* (2013.01)

(58) Field of Classification Search

CPC . B02C 13/286; B02C 13/28609; B02C 17/22; B02C 17/225; B02C 17/1835; B02C 17/1855

See application file for complete search history.

(56) References Cited

U.S. PATENT DOCUMENTS

| | | | | |
|---|---|---|---|---|
| 4,172,560 | A * | 10/1979 | Butler | B02C 17/06 241/171 |
| 4,646,980 | A * | 3/1987 | Player | B02C 17/1855 241/179 |
| 5,361,997 | A * | 11/1994 | Burkes | B02C 17/1855 241/183 |
| 8,308,906 | B2 | 11/2012 | Page et al. | |
| 8,360,350 | B2 | 1/2013 | Mepham et al. | |
| 9,289,775 | B2 | 3/2016 | Mepham et al. | |
| 9,440,236 | B2 * | 9/2016 | Macinnes | B02C 17/1825 |
| 10,668,477 | B2 * | 6/2020 | Latchireddi | B02C 17/1855 |
| 2017/0014831 | A1 | 1/2017 | Mepham et al. | |

FOREIGN PATENT DOCUMENTS

WO WO2016044936 A1 3/2016

* cited by examiner

*Primary Examiner* — Matthew Katcoff

(57) ABSTRACT

A discharge end wall system including a discharge wall assembly in which a number of pulp chambers are defined, and one or more plug elements at least partially occupying one or more of the pulp chambers.

5 Claims, 11 Drawing Sheets

DISCHARGE END WALL SYSTEM

CROSS-REFERENCE TO RELATED APPLICATION

This application claims the benefit of U.S. Provisional Patent Application No. 62/689,884, filed on Jun. 26, 2018, the entirety of which is hereby incorporated herein by reference.

FIELD OF THE INVENTION

The present invention is a discharge end wall system including a discharge end wall assembly in which a number of pulp chambers are defined, and one or more plug elements located in one or more selected pulp chambers.

BACKGROUND OF THE INVENTION

As is well known in the art, various elements of a grinding mill typically are subjected to wear in characteristic patterns, in which certain surfaces of certain elements are subjected to greater wear than other surfaces.

As can be seen in FIGS. 1A-1E, a conventional discharge wall assembly 20 in a typical grinding mill 21 (FIG. 1E) includes a number of vanes or pulp lifters 22 (FIGS. 1A-1D) that extend inwardly toward a central hole 24 from a shell wall or outer perimeter wall 26 of a mill shell 23 (FIG. 1E). The vanes or pulp lifters 22 are at least partially mounted on a discharge end wall 27 (FIGS. 1A, 1E). The pulp lifters 22 are intended to direct pulp that includes ore particles and water through pulp chambers 28 to the central hole 24, through which the pulp exits the grinding mill 21. In the example illustrated in FIGS. 1A-1D, the vanes 22 include shorter and longer vanes. As is well known in the art, various arrangements of longer and shorter vanes, and possibly additional vanes of longer or shorter or intermediate length (not shown in FIGS. 1A-1D), may be used. The optimum design depends on a number of parameters, e.g., the hardness of the ore, and the cost of energy inputs, as is also known.

As is well known in the art, the vanes or pulp lifters 22, the outer perimeter wall 26, and the discharge end wall 27, at least partially define the pulp chambers 28 therebetween. Each pulp chamber is located between a leading pulp lifter and a trailing pulp lifter, relative to the direction of rotation. Typically, when the grinding mill is in use, discharge grates "DG" (FIG. 1E) are located on the pulp chambers 28 and include apertures to screen the flow of slurry or pulp into the pulp chambers, i.e., to limit the solid particles in the slurry or pulp entering the pulp chambers to particles sized smaller than the apertures in the grates. The discharge grates "DG" also partially define the respective pulp chambers.

The discharge grates are omitted from FIGS. 1A-1D for clarity of illustration. The location where a discharge grate "DG" would be positioned (i.e., over an outer portion "OP" of a pulp chamber) is illustrated in FIG. 1A. It will be understood that blind plates "BP" are also located on each pulp chamber, and these are located radially inwardly from the discharge grates. The blind plates "BP" cover an inner portion "IP" of the pulp chamber. The location of a blind plate "BP" is indicated in FIG. 1A.

It will also be understood that the majority of the solid particles in the pulp (i.e., primarily ore that has been ground), which exit the pulp chambers via the central hole 24, are omitted from FIGS. 1A-1E for clarity of illustration. As is well known in the art, the slurry or pulp is a heterogeneous mixture of solid particles and water. Some finer particles may be suspended in the water. The ore and the ore particles typically include some waste material.

As is well known in the art, the mill shell 23 of the grinding mill 21 defines a mill shell chamber 25 upstream from the pulp chambers, and the mill shell 23 is rotatable about an axis of rotation "AX" (FIG. 1E). When the grinding mill is operating, a charge (identified in FIG. 1E by the reference character "CH") is located in the mill shell chamber 25. The charge (i.e., ore, water, and grinding media, if grinding media are used) may fill the mill shell chamber up to a level indicated by a line "A" in FIGS. 1A and 1C-1E. The direction of rotation of the mill shell 23 is indicated by arrow "R" in FIGS. 1A-1D.

Typically, the ore is added into the grinding mill at an input end (as schematically represented by arrow "IN" in FIG. 1E), and water is also added into the mill shell chamber 25 of the grinding mill 21. The charge is rotated as the mill shell of the grinding mill rotates, subjecting the ore to comminution and resulting in finely-ground ore particles that are included in the slurry or pulp that is passed to an output, or discharge, end of the grinding mill. The movement of the ore particles and water through the discharge grates "DG" and into the pulp chambers is schematically represented by arrows "OP" in FIG. 1E. From the foregoing, it can be seen that, as the mill shell 23 rotates, the pulp chambers 28 are also rotated.

It will be understood that the top surface of the charge (identified as "A" in FIGS. 1A and 1C-1E) may vary significantly, depending on a number of parameters, and the level illustrated in FIGS. 1A and 1C-1E is exemplary only. (As will be described, embodiments of the invention are illustrated in the balance of the attached drawings.) It will also be understood that the direction of rotation may be clockwise or counter-clockwise, depending on how the mill is manufactured and installed. The selection of a counter-clockwise direction of rotation, as illustrated in FIGS. 1A-1D, is arbitrary, and is made for the purpose of illustration.

Ideally, each respective pulp chamber would be completely vacated due to gravity while the pulp chamber is located above the charge. This would mean that, in an ideal situation, each of the pulp chambers would be vacated prior to their respective immersions in the charge, in each rotation of the mill shell. As will be described, however, in the prior art, "carryover" of pulp (some pulp remaining in the pulp chamber when the pulp chamber is re-immersed in the charge) frequently imposes increased costs.

As each of the pulp chambers is immersed in the charge in turn, the slurry flows into each pulp chamber successively. As can be seen in FIGS. 1A-1D, depending on the amount of the charge in the mill shell chamber, a pulp chamber may be immersed (in whole or in part) as it is rotated from about the nine o'clock position to about the three o'clock position, when the rotation is counter-clockwise.

Once the respective pulp chambers are raised above the charge, each of the pulp chambers is at least partially emptied, as they are moved in the direction indicated by arrow "R". In the example illustrated in FIGS. 1A-1D, as a particular pulp chamber is moved from about the three o'clock position to about the nine o'clock position (i.e., when it is located above the line designated "A"), the pulp in that pulp chamber is directed by gravity generally toward the central hole by the vanes or pulp lifters that partially define that pulp chamber (i.e., one such vane being located on each side of the pulp chamber). In the prior art, however, not all of the pulp is vacated from the pulp chambers, resulting in "carryover", i.e., pulp that remains at least temporarily in the pulp chamber for more than one rotation thereof.

The vanes or pulp lifters also support the pulp that is positioned on them respectively, and direct the pulp generally toward the central hole, when the vanes are rotated from approximately the three o'clock position to approximately the nine o'clock position. The movement of the pulp from the pulp chambers and into the central hole 24 is schematically represented by arrow "EX" in FIG. 1E.

The elements engaged by the pulp as the pulp moves in the pulp chambers are thereby subjected to wear. Significant wear results from the pulp that is "carried over". As is known in the art, due to the concentration of wear on certain surfaces of certain elements in the discharge wall assembly due to carryover, such elements may need to be replaced, even though other parts of the elements have been subjected to relatively little wear. As a result, because of carryover, significant costs may be incurred due to excessive wear that is concentrated in a relatively small area of a surface of an element.

First, costs are incurred in connection with purchasing a new element or component, e.g., all or part of a vane or pulp lifter. Second, costs are also incurred in connection with the replaced element, e.g., although the replaced element may be worn in only a small portion thereof, it is prematurely replaced, as other portions of the elements may not be worn out. Third, and most important, significant costs are incurred due to the downtime required to replace an element that is prematurely worn.

The characteristic movements of certain of the ore particles in the pulp in the pulp chambers are illustrated in FIGS. 1A-1D. It is believed that at least some of the wear to which the elements forming the pulp chambers is subjected is due to the movement of "carryover" pulp.

As noted above, ideally, the pulp chamber should be fully emptied before it is next re-immersed in the charge. However, in practice, it often happens that a significant portion of the pulp does not exit the pulp chamber by the time that the pulp chamber has reached the nine o'clock position, assuming a counter-clockwise direction of rotation. The pulp remaining in the pulp chamber, at a point when it ideally all should have been discharged to the central hole, is typically referred to as "carryover".

"Carryover" of pulp in grinding mills (i.e., the incomplete discharge of pulp in pulp chambers within one revolution of a mill shell) is a serious problem. It is believed that the extent of carryover may be as high as 50% of capacity or more, depending on the circumstances. Carryover imposes many costs on the operator, as noted above. In particular, it appears that some of the wear to which the elements mounted on the discharge end wall are subjected is due to carryover.

The movement of the pulp that is carried over is schematically illustrated in FIGS. 1A-1D. It will be understood that the illustrations in FIGS. 1A-1D are based on computer-generated graphic simulations of the movement of the pulp in the pulp chambers as the mill shell rotates.

The reasons for carryover are well-known in the art. The mill shell may be, for example, about 40 feet in diameter. The relatively high mill shell rotation speed, e.g., about 10 rpm, is an important factor. This relatively fast rotation speed means that the discharge wall 27 completes one rotation every six seconds. Accordingly, the pulp in a particular pulp chamber has only approximately three seconds, at most, to exit the pulp chamber 28, i.e., to be moved to the central hole 24, through which it may exit. In addition, due to the rotation of the mill shell, the pulp in each pulp chamber is urged outwardly by centrifugal force, i.e., away from the central hole 24, effectively slowing the exit of the pulp from the pulp chamber as the pulp chamber moves from approximately the three o'clock position to approximately the nine o'clock position, if rotating counter-clockwise. It is believed that carryover is the consequence of there being insufficient time allowed for full evacuation of the pulp chambers.

It has been determined that the movement of the pulp that is carried over, inside the pulp chamber, is distinctive to the specific grinding mill, and generally consistent. In general, because the pulp that is "carried over" typically is located on the trailing side of a leading pulp lifter for a short period of time in every rotation, the trailing sides of the pulp lifters are thereby subjected to more wear than other elements of the discharge wall assembly 20. As will be described, for a short time while the carried-over pulp is supported by and engaged with the trailing side of the leading pulp lifter, the carried-over pulp is also moved relative to the trailing side, i.e., the carried-over pulp tends to shift while supported by the trailing side. However, the wear is not necessarily uniform over different pulp chambers in a particular mill, for reasons that are unclear.

For example, in FIG. 1A and FIG. 1B, pulp chambers identified for convenience by reference numerals 28A-28E are shown with ore particles 30 of the pulp therein. (It will be understood that only a portion of the ore particles that are in the pulp are illustrated in FIGS. 1A-1D, and the sizes of the ore particles 30 are exaggerated, for clarity of illustration. Also, the water in the pulp is omitted from FIGS. 1A-1D, for clarity of illustration.) As can be seen in FIGS. 1A and 1B, as an example, pulp chamber 28A is partially defined between a pair of the vanes or pulp lifters identified for convenience by reference numerals 122 and 122A, which are the trailing and leading pulp lifters respectively for the pulp chamber 28A, relative to the direction of rotation. As illustrated, when the pulp chamber 28A is approximately in the eleven o'clock position, the solid particles 30 start to fall from a leading side 132 of the vane 122 (FIG. 1B).

In pulp chamber 28B, partially defined between a pair of the vanes identified in FIGS. 1A and 1B for convenience as 122A and 122B, the movement of the solid particles 30 toward a trailing side 134B of the leading vane 122B (for pulp chamber 28B) is more pronounced, because the pulp chamber 28B as illustrated is further along in the counter-clockwise rotation than the pulp chamber 28A. (It will be understood that of the pair of the pulp lifters that define the pulp chamber 28B, the pulp lifter 122A is the trailing pulp lifter, and the pulp lifter 122B is the leading pulp lifter.) It will be understood that, immediately before the pulp lifter 122A was located approximately at the eleven o'clock position, at least some of the particles 30 would have been positioned on the leading side 132A of the trailing pulp lifter 122A (FIG. 1B).

In FIGS. 1A, 1B, and 1C, pulp chambers 28C, 28D, and 28E show the solid particles 30 progressively moved further onto the trailing side of the leading pulp lifter in each pulp chamber respectively, due to the changing positions of the respective pulp lifters relative to the vertical as the mill shell rotates, and due to the effects of gravity on the ore particles 30. In particular, in FIGS. 1A, 1B, and 1C, it can be seen that, in the pulp chambers 28D, 28E (located at the nine o'clock position, or almost at such position) the ore particles 30 that will be carryover are positioned in a middle or intermediate area 35 of the trailing side of the leading pulp lifter. As can be seen in FIG. 1B, the ore particles 30 that are to be carried over are spaced apart from the shell wall 26 by a distance 36 (FIG. 1B).

As can be seen in FIG. 1D, the carried-over ore particles 30 move downwardly, to pile on the outer perimeter wall 26, when the pulp chambers are at or close to the six o'clock position. Those skilled in the art would also appreciate that the slurry that flows into the pulp chambers, to fill them when the pulp chambers are positioned below the surface of the charge, is also omitted from FIGS. 1A-1D, for clarity of illustration. It will be understood that, although omitted, the pulp (the ore particles and water) quickly fill the immersed pulp chambers, once the pulp chambers are re-immersed in the charge.

Those skilled in the art would also appreciate that, to the extent that the pulp chamber is occupied by the "carried-over" pulp, the pulp chamber would be unable to receive the pulp that otherwise may have flowed therein while the pulp chamber is immersed. Accordingly, carryover also negatively affects throughput. Carryover also requires higher energy consumption, because the carried over pulp is required to be rotated.

It can be seen in FIGS. 1A-1D that, although the solid particles 30 in a particular pulp chamber have been moved part of the distance toward the central hole when the pulp chambers are at approximately the nine o'clock position or prior thereto (when rotation is counter-clockwise), the particles 30 that are illustrated as carryover do not reach the central hole.

The particles 30 that are destined to become carryover in the example illustrated in FIGS. 1A-1D are, at one point while the mill shell rotates, generally located in the middle area 35 of the trailing side of the pulp lifter, i.e., they are temporarily located a relatively short distance from the central hole. In FIGS. 1A, 1B, and 1C, it can be seen that the particles 30 have moved from the leading side of the trailing pulp lifter to the middle area 35 of the trailing side of the leading pulp lifter as the pulp chamber 28 in which the particles 30 are located has moved from approximately the three o'clock position to approximately the nine o'clock position. However, because the particles 30 that are illustrated have not reached the central hole 24 when the pulp chamber they are in is at approximately the nine o'clock position, they are returned to engage the outer perimeter wall 26 as the pulp chamber in which they are located moves further (counter-clockwise, as illustrated in FIGS. 1A-1D) from approximately the nine o'clock position. For these particles 30, the gains achieved during this rotation (i.e., the distances moved toward the central hole) are lost when the pulp chamber moves past the nine o'clock position.

It will also be appreciated that the carried-over solid particles 30 move to the outer wall 26 when the pulp chamber(s) in which they are located is next re-immersed in the charge, as illustrated in FIG. 1D. The carried-over ore particles 30 will only exit the mill (i.e., via the central hole 24) in the next rotation if such solid particles reach the central hole during such rotation. Accordingly, it can be seen that some of the pulp that is carried over to the subsequent rotation may be carried over for several rotations.

In FIGS. 1A-1D, it can also be seen that the carryover of the ore particles 30 results in increased wear on certain portions of the pulp lifters 22, and also on the shell wall 26. For instance, as illustrated in FIGS. 1A and 1B, when the pulp lifter 122 is just past the vertical position (i.e., the twelve o'clock position), the solid particles 30 of the carryover fall from the leading side 132 of the pulp lifter 122, and it will be understood that many of such particles 30 engage the trailing side 134A of the adjacent (leading) pulp lifter 122A. In this way, the middle area 35 of the trailing side of each leading pulp lifter is subjected to wear due to the ore particles 30 that are carried over, in particular by the sliding movement of the ore particles 30 on the middle area 35.

The trailing side of each of the pulp lifters is subjected to impact (or dynamic) loading of the ore particles 30 onto the trailing side of the pulp lifter, at a location on the trailing side generally identified as "I" in FIG. 1B. Such dynamic loading occurs when the pulp lifter is located approximately at the eleven o'clock position to the ten o'clock position, in a counter-clockwise rotation. As illustrated in FIG. 1B, for example, the trailing side 134B of the leading pulp lifter 122B is subjected to dynamic loading when the pulp lifter 122B is approximately at the ten o'clock position.

The positions of the carried-over ore particles 30 shift inside the pulp chamber 28 as the mill shell rotates. As can be seen in FIG. 1D, the solid particles 30 that are carried over tend to accumulate in the pulp chamber 28 on the outer perimeter wall 26, when the pulp chamber 28 is at or near the six o'clock position. (As noted above, other ore particles included in the pulp entering into the pulp chambers when they are immersed in the charge are omitted from FIGS. 1A and 1C-1D for clarity of illustration.) The portions "$D_1$", "$D_2$" of the pulp lifters partially defining the pulp chamber that are proximal to the mill shell wall 26 may also be subjected to wear due to carryover, as are the portions "E" of the outer perimeter wall of the mill shell (FIG. 1D) that partially define the pulp chamber 28.

In FIG. 1B, certain ore particles that are not destined to be included in carryover are also illustrated, identified by the reference numeral 31. The ore particles 31 move downwardly toward the central hole 24, as schematically represented by arrows "J" in FIG. 1B. However, due to the lengths of certain pulp lifters, those pulp lifters are subjected to impact loading of the ore particles onto the trailing sides of the pulp lifters, at locations on the trailing sides identified as "K" in FIG. 1B. Accordingly, as illustrated in FIG. 1B, the longer pulp lifters may also be subjected to excess wear proximal to their respective inner ends, at "K".

SUMMARY OF THE INVENTION

There is a need for a discharge end wall system that overcomes or mitigates one or more of the defects or disadvantages of the prior art. Such disadvantages or defects are not necessarily included in those listed above.

In its broad aspect, the invention provides a discharge end wall system mounted on a discharge end wall of a mill shell in a grinding mill. The mill shell is rotatable about an axis of rotation thereof in a direction of rotation to produce a pulp including ore particles and water. The discharge end wall is partially defined by an outer perimeter wall of the mill shell, and includes a central hole through which the pulp exits the mill shell. The discharge end wall system includes a number of pulp lifters arranged on the discharge end wall at least partially radially relative to the axis of rotation. The pulp lifters are arranged in pairs of adjacent pulp lifers, each pair including a leading and a trailing pulp lifter relative to the direction of rotation. For each pair of pulp lifters, a trailing edge surface of the leading pulp lifter and a leading edge surface of the trailing pulp lifter partially define a pulp chamber therebetween.

The discharge end wall system additionally includes one or more plug elements located in one or more selected pulp chambers. The plug element is formed to occupy at least a portion of the selected pulp chamber to define a reduced pulp chamber therein. The pulp chambers other than the selected pulp chambers include a number of open pulp chambers. The plug element is sized and located for optimal flow of the pulp through the open pulp chambers and the reduced pulp chamber(s) of the discharge end wall assembly.

In another of its aspects, the invention includes a method of minimizing carryover of the pulp. The method includes providing one or more plug elements, to be positioned in at least a predetermined portion of one or more selected pulp chambers. Also the one or more selected pulp chambers are selected. The plug elements are then installed in each of the selected pulp chambers, to occupy the predetermined portion of each of the selected pulp chambers, through which the pulp is flowable.

BRIEF DESCRIPTION OF THE DRAWINGS

The invention will be better understood with reference to the attached drawings, in which.

DETAILED DESCRIPTION

Figure 1A:
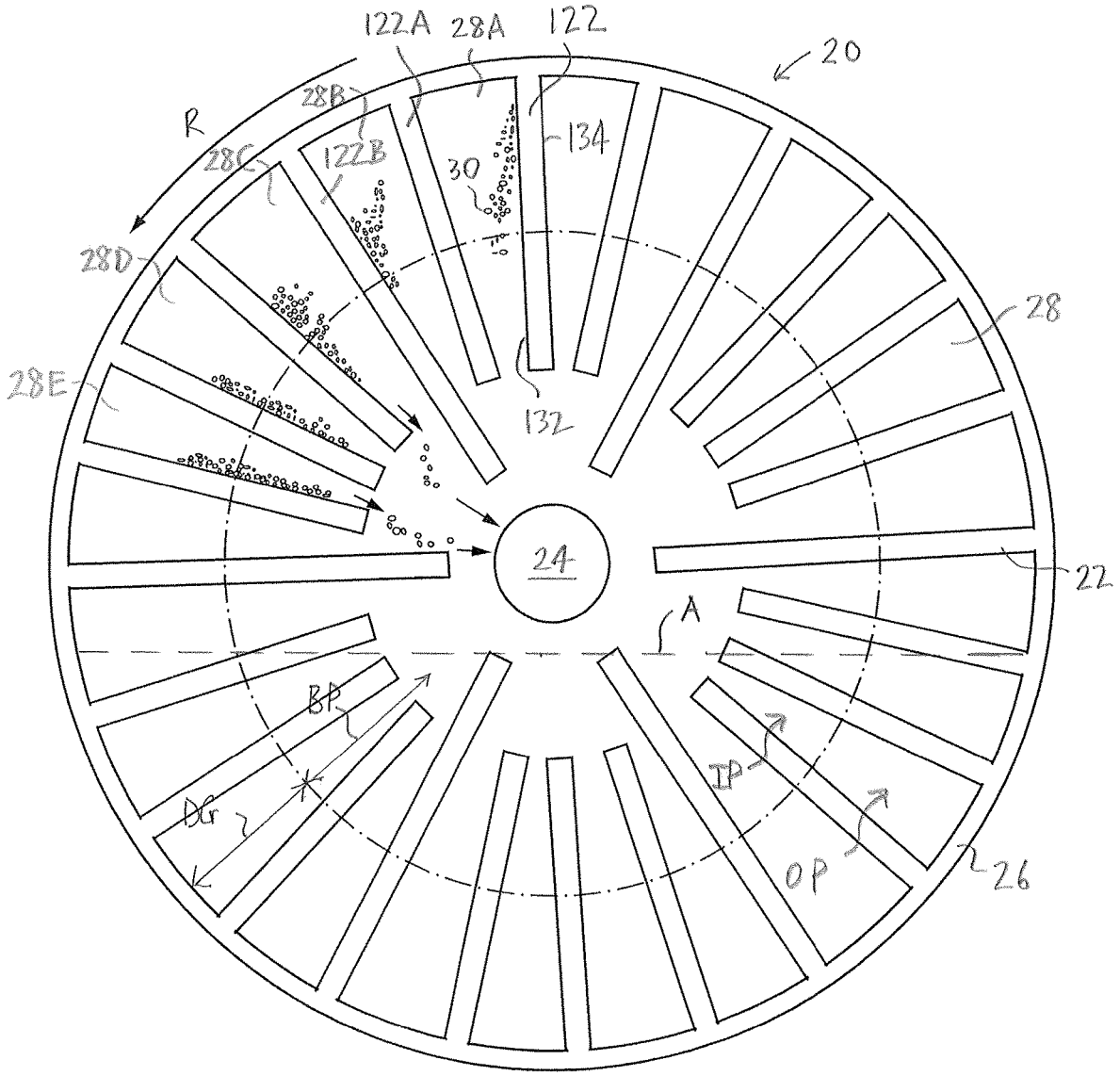
FIG. 1A (Prior Art)
FIG. 1A (also described previously) is a schematic illustration showing certain selected solid particles in selected pulp chambers in a discharge wall assembly of the prior art located at first locations between the nine o'clock and three o'clock positions thereof and moving in a counter-clockwise rotation direction.
Figure 1B:
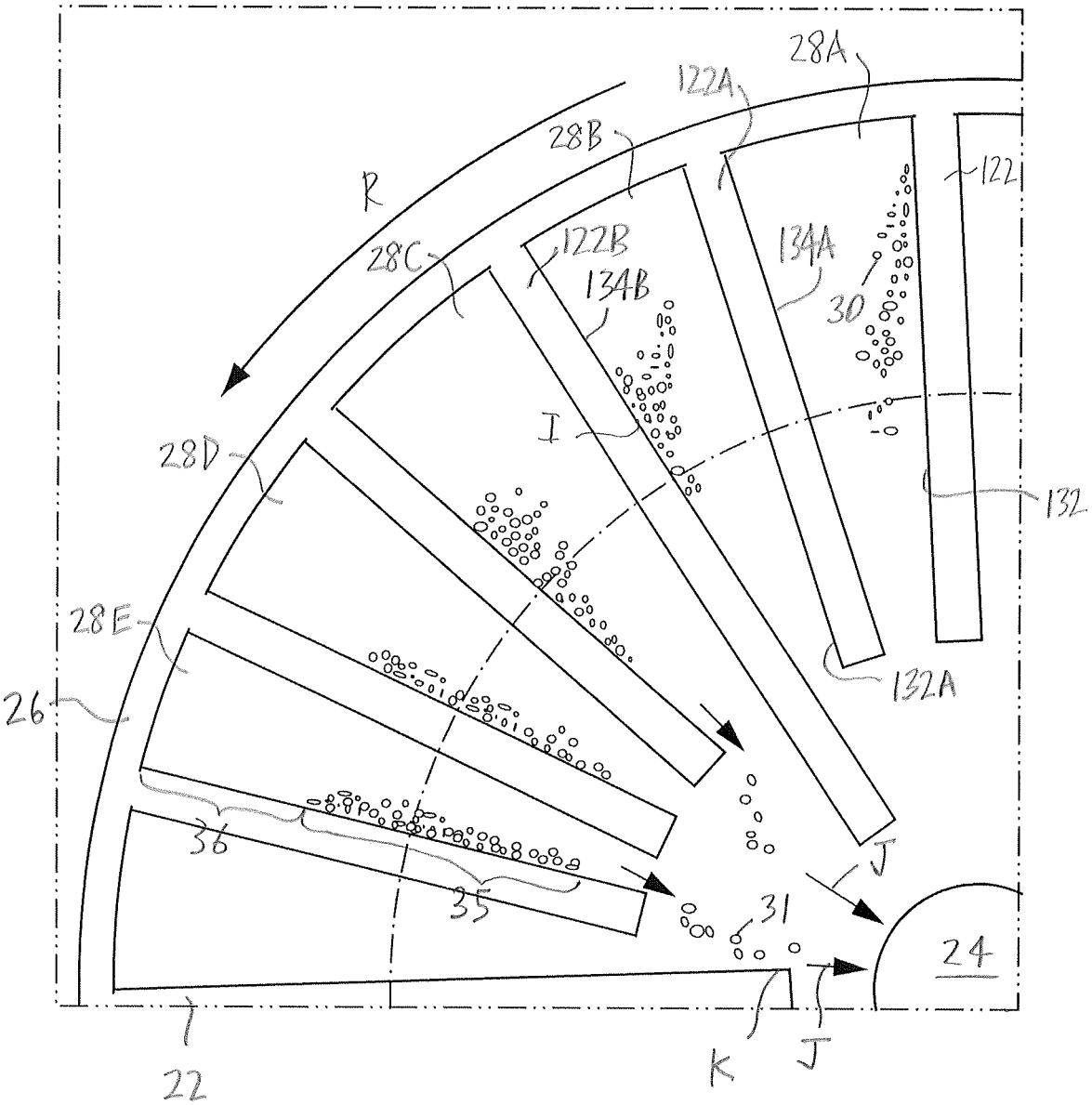
FIG. 1B (Prior Art)
FIG. 1B (also described previously) is an illustration of a portion of the discharge wall assembly of FIG. 1A, drawn at a larger scale.
Figure 1C:
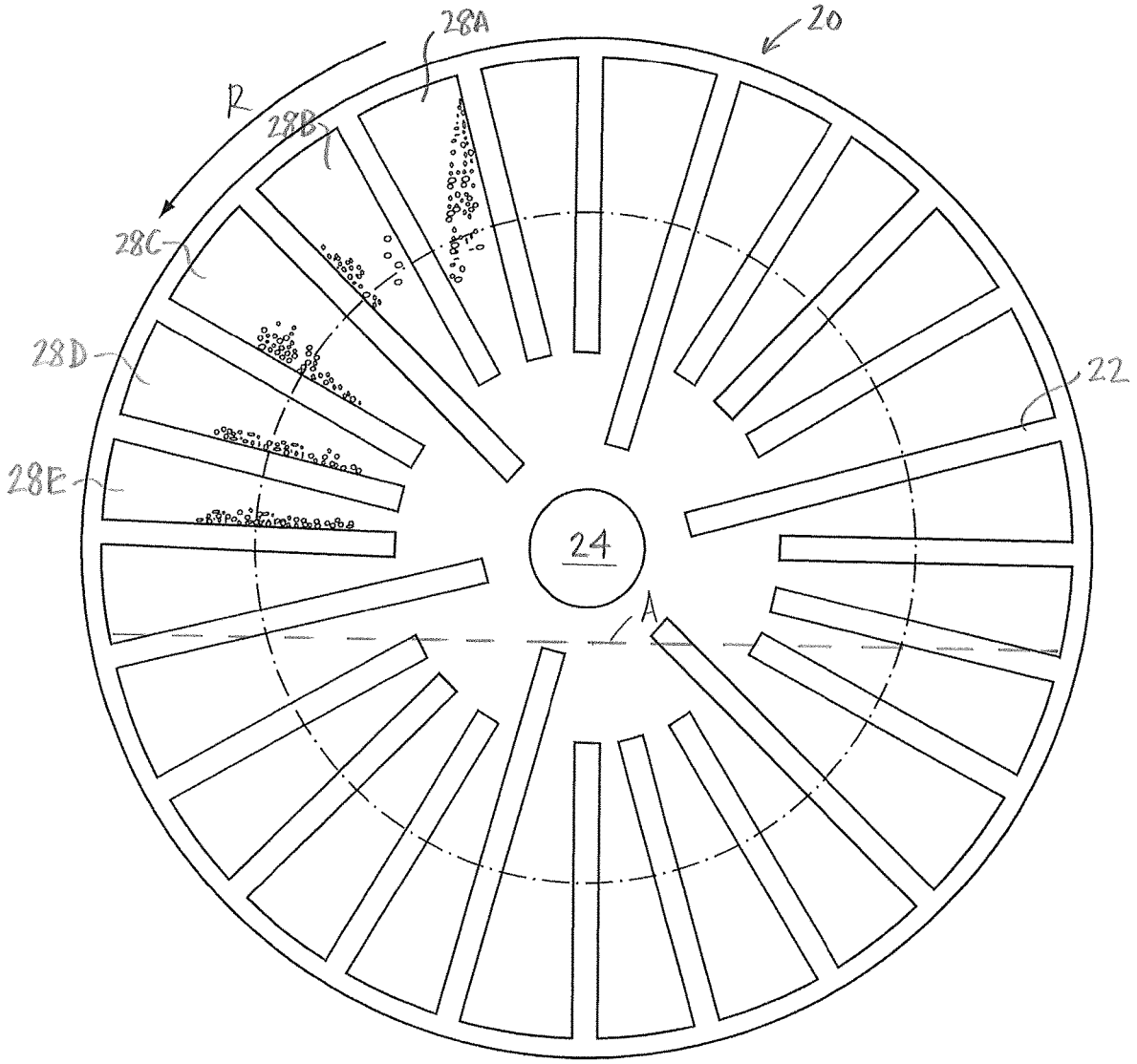
FIG. 1C (Prior Art)
FIG. 1C (also described previously) is a schematic illustration of the pulp chambers of FIG. 1A and the selected solid particles therein further in the rotation direction.
Figure 1D:
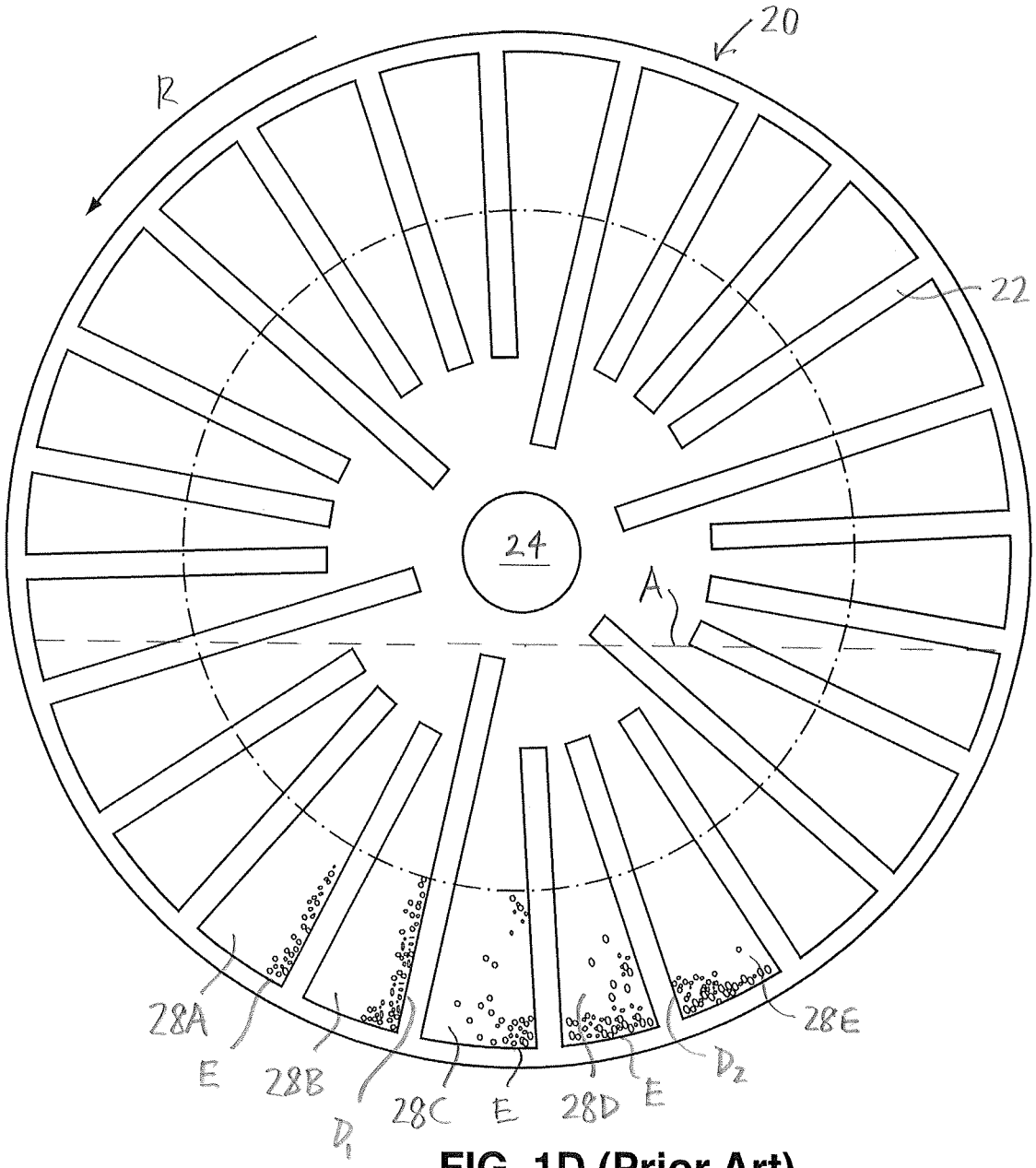
FIG. 1D (Prior Art)
FIG. 1D (also described previously) is a schematic illustration of the pulp chambers of FIGS. 1A and 1B and the selected solid particles therein further in the rotation direction.
Figure 1E:
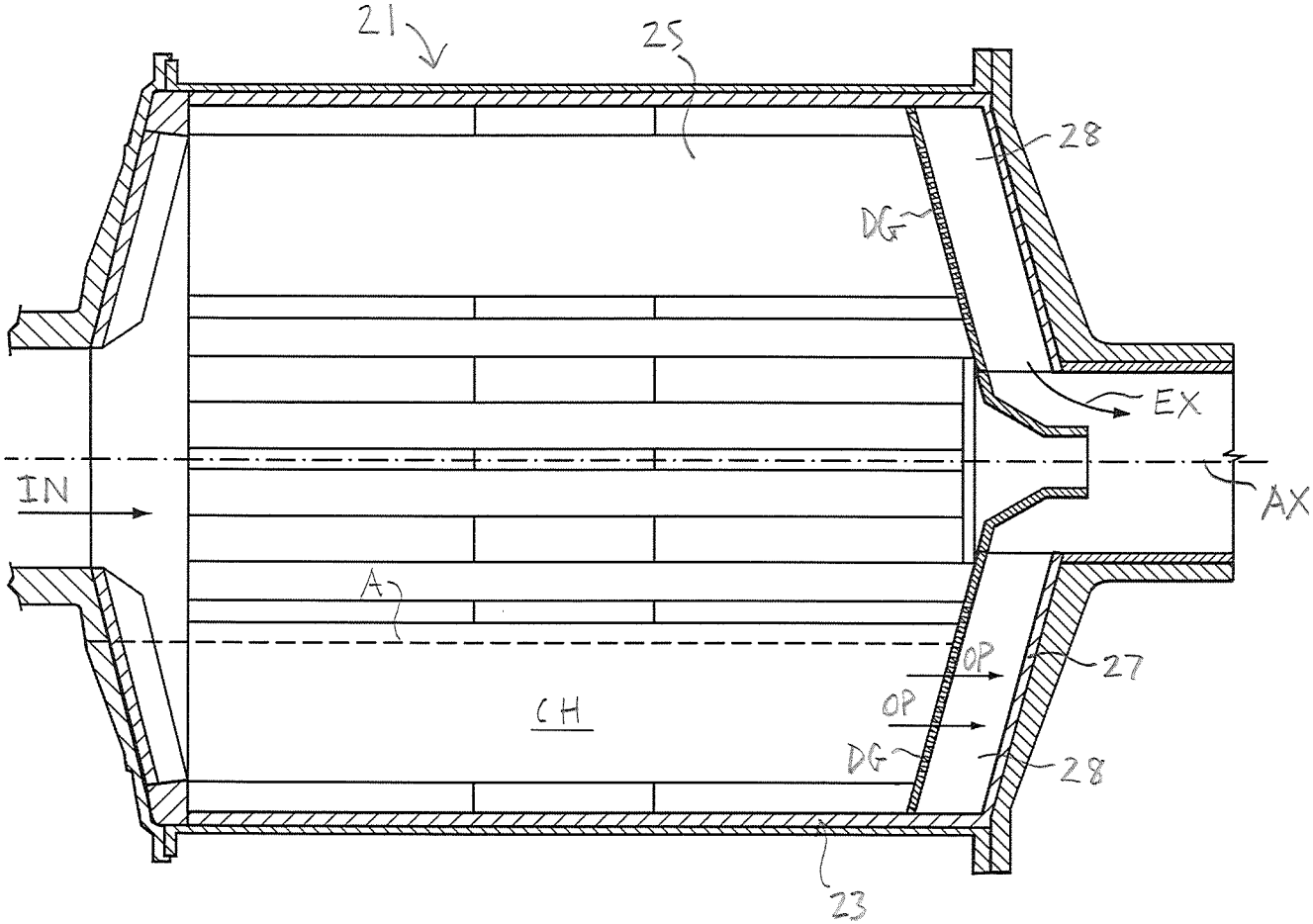
FIG. 1E (Prior Art)
FIG. 1E (also described previously) is a longitudinal cross-section of a conventional grinding mill, drawn at a smaller scale.

In the attached drawings, like reference numerals designate corresponding elements throughout. In particular, to simplify the description, the reference numerals previously used in FIGS. 1A-1E are used again in connection with the description of the invention hereinafter, except that each such reference numeral is raised by 100 (or by whole number multiples thereof, as the case may be), where the elements described correspond to elements referred to above.

Reference is made to FIGS. 2A-3A to describe an embodiment of a discharge end wall system of the invention indicated generally by the numeral 240. The discharge end wall system 240 preferably is mounted on a discharge end wall 227 of a mill shell 223 in a grinding mill 221. The mill shell 223 is rotatable about an axis of rotation "$AX_1$" thereof in a direction of rotation to produce a pulp including ore particles and water. The discharge end wall 227 is partially defined by an outer perimeter wall 226 of the mill shell 223 and includes a central hole 224 through which the pulp exits the mill shell 223. In one embodiment, the discharge end wall system 240 preferably includes a discharge end wall assembly 242.

Figure 3A:
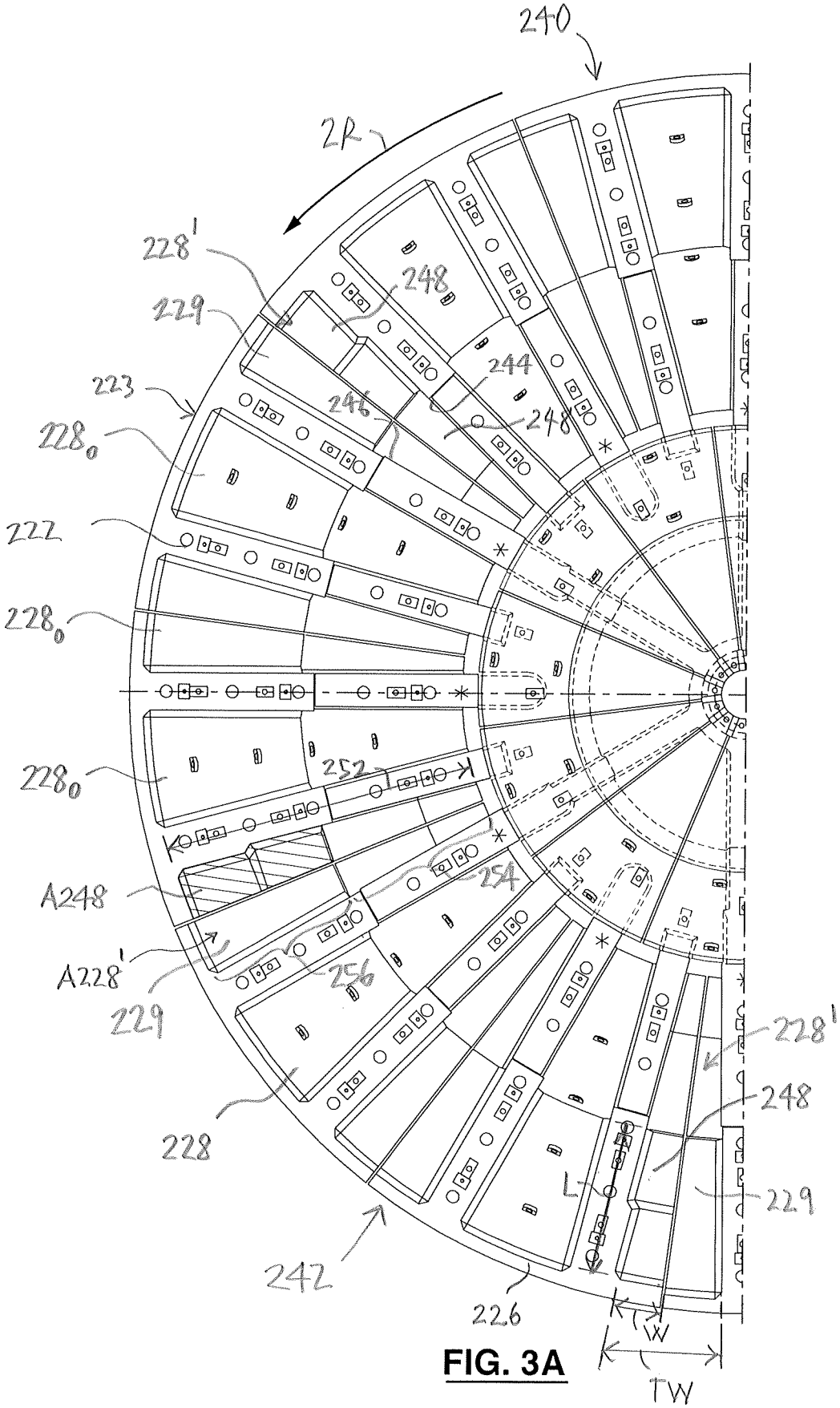
FIG. 3A is a portion of the discharge end wall assembly of FIG. 2A, drawn at a larger scale.

As will be described, the discharge end wall assembly 242 preferably includes a number of pulp lifters 222 that are arranged on the discharge end wall 227 relative to the axis of rotation "$AX_1$". It is preferred that the pulp lifters 222 are arranged in pairs of adjacent ones thereof. Each pair respectively includes a leading one of the pulp lifters in the pair and a trailing one of the pulp lifters in the pair relative to the direction of rotation. As will also be described, a trailing edge surface 244 of the leading one of the pulp lifters 222 and a leading edge surface 246 of the trailing one of the pulp lifters partially define respective pulp chambers 228 therebetween (FIG. 3A).

It is also preferred that the discharge end wall system 240 includes one or more plug elements 248 located in one or more selected pulp chambers 228'. Preferably, the plug element 248 is formed to occupy at least a portion of the selected pulp chamber 228'. For the purposes hereof, the pulp chambers other than the selected pulp chamber(s) 228' are referred to as open pulp chambers $\mathbf{228}_O$. In the cases where the plug element 248 does not fill the selected chamber 228' completely, a modified or reduced pulp chamber 229 is defined in the selected chamber 228' at least in part by the plug element 248 therein. The volume of the reduced pulp chamber 229 is the difference between the volume of the selected pulp chamber 228' (i.e., prior to the insertion of the plug element 248 therein) and the volume of the plug element 248. In one embodiment, the pulp is receivable in the reduced pulp chamber 229.

As will be described, it has been found that the size and location of the plug elements 248 may be selected for optimum flow of the pulp through the discharge wall assembly 240. Surprisingly, the optimum flow rate may be achieved by including the plug elements in the selected pulp chambers 228'. The optimum flow rate brings advantages further described below. It will be understood that the optimum flow rate of the pulp through the discharge wall assembly 240 preferably is achieved when the discharge wall assembly rotates at a preselected rotation speed.

Figure 2B:
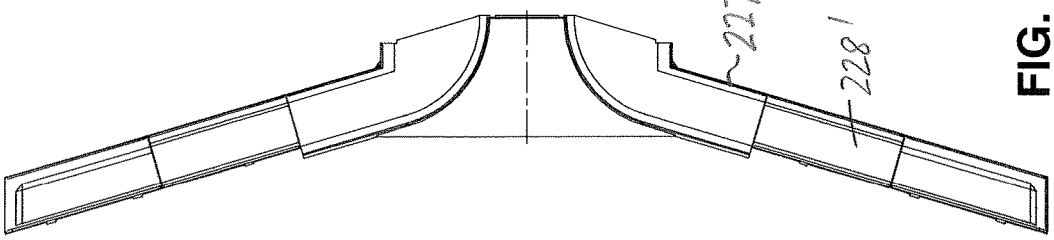
FIG. 2B is a cross-section of the discharge end wall assembly of FIG. 2A, drawn at a larger scale.
Figure 2A:
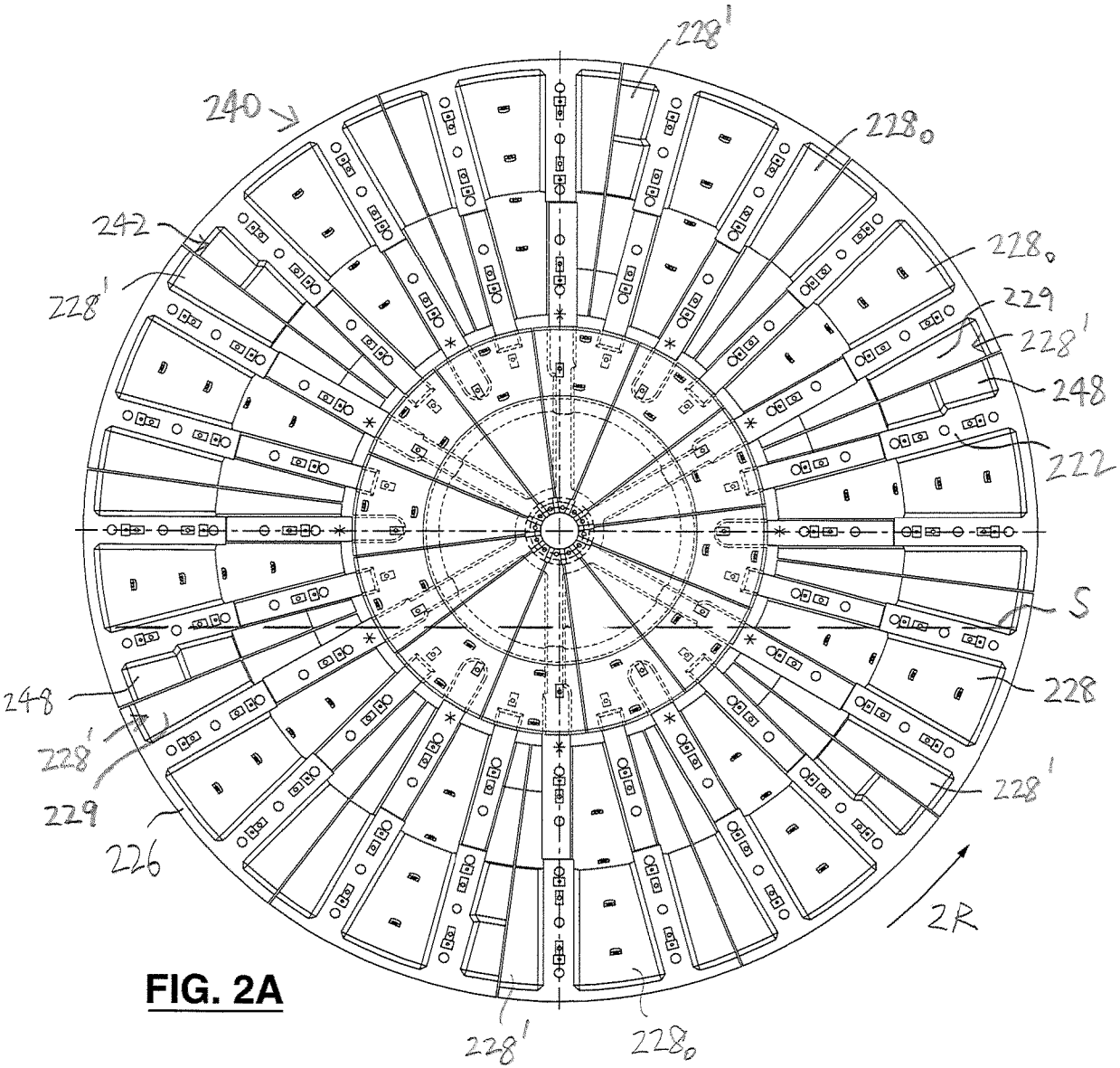
FIG. 2A is an elevation view of an embodiment of a discharge end wall assembly of the invention including a number of partially occupied pulp chambers, drawn at a larger scale.

As will be described, it is believed that, in at least most cases, the plug element 248 preferably occupies only a predetermined portion of the volume of the selected pulp chamber 228', in the optimum design. The reduced pulp chamber 229 is a portion of the pulp chamber 228' that is not occupied by the plug element 248. It is also believed that in the optimum design, in at least most cases, the plug element preferably is included only in certain pulp chambers of the discharge wall assembly, i.e., in one embodiment, the plug element 248 preferably is not positioned in every pulp chamber in the discharge end wall assembly. For instance, in the example illustrated in FIG. 2A, one-quarter of the pulp chambers in the discharge end wall assembly are selected for the plug elements to be positioned therein. Also, and as illustrated in FIG. 2A, the selected pulp chambers 228' preferably are uniformly distributed throughout the discharge wall assembly.

However, the discharge end wall system of the invention may include the plug elements in each of the pulp chambers therein. It will be understood that the optimum design in each case would depend on a number of parameters. As a practical matter, the optimum design may be determined by trial and error, e.g., using computer simulation.

It will be understood that the plug element 248 may be located in a pulp chamber having any suitable configuration. For instance, in the attached drawings the pulp lifters as illustrated are straight, and positioned substantially equidistant from each other, radially relative to the axis of rotation. However, it will be understood that, alternatively, the pulp lifters may be curved.

Those skilled in the art would appreciate that, as a practical matter, the plug elements 248 may be retrofitted into an existing discharge end wall assembly, to improve the overall performance thereof. Alternatively, the discharge end wall system may include the plug element when initially installed.

Figure 2C:
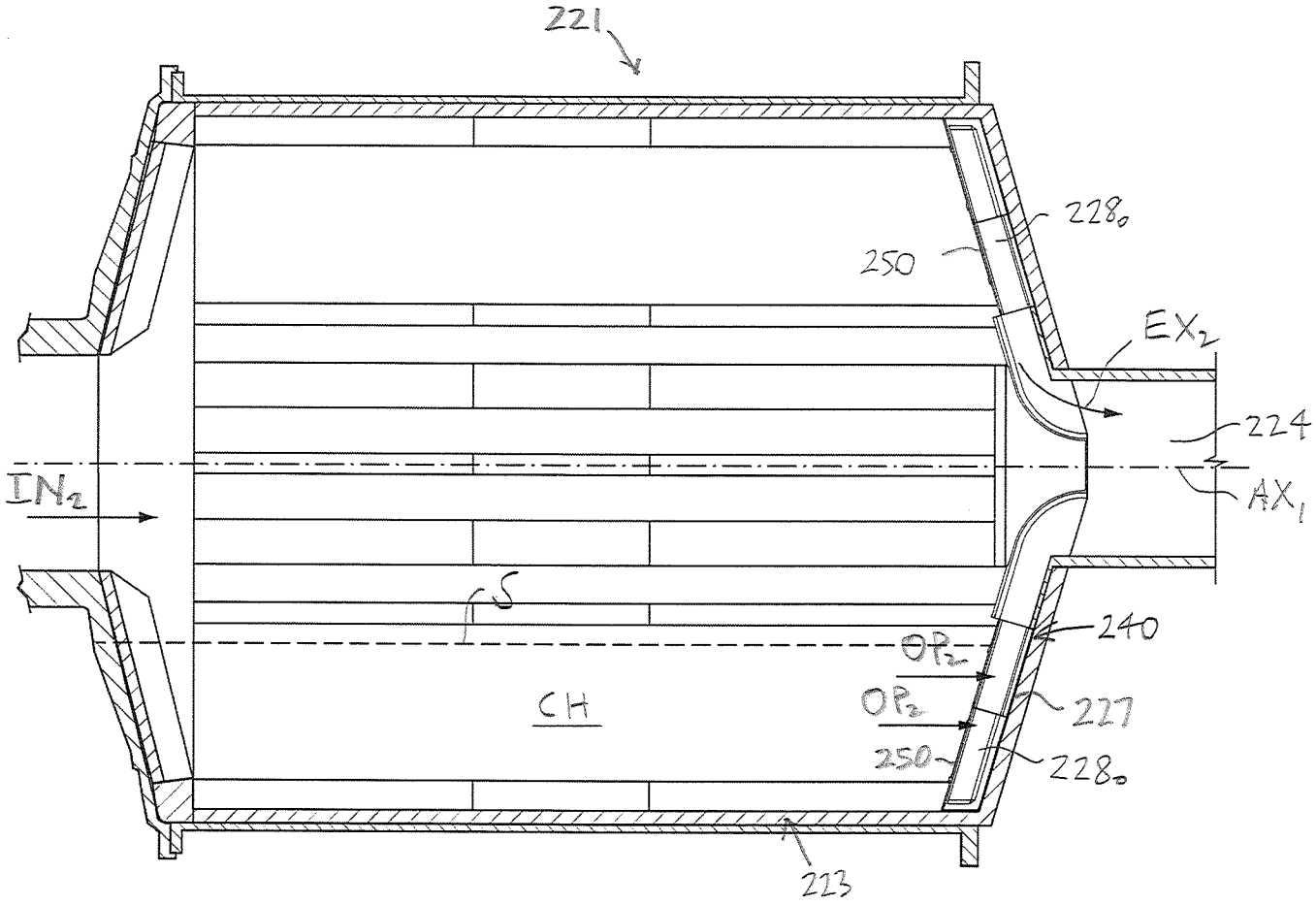
FIG. 2C is a longitudinal cross-section of an embodiment of a grinding mill of the invention, drawn at a smaller scale.

As illustrated in FIGS. 2A and 3A, the mill shell 223 is rotated in a counter-clockwise direction, indicated by arrow "2R". The discharge end wall system 240 is mounted on the discharge end wall 227, and therefore the discharge end wall system 240 rotates with the mill shell 223. The charge "CH" is introduced into the grinding mill 221 at its intake end, as indicated by arrow "$IN_2$" in FIG. 2C. The pulp flows into the immersed pulp chambers 228 (or at least the portions of the pulp chambers that are immersed, when they are only partially immersed), via discharge grates 250, as indicated by the arrows "$OP_2$" in FIG. 2C. It will be understood that, for clarity of illustration, only two open pulp chambers $\mathbf{228}_O$ are illustrated in FIG. 2C. It will also be understood that the selected pulp chambers 228' are also immersed in turn as the discharge end wall assembly rotates.

It will also be understood that the grinding mill 221 of the invention preferably includes the discharge end wall system 240 of the invention. As noted above, the discharge end wall system 240 preferably includes one or more selected pulp chambers 228', in which the plug elements 248 are respectively located, to define the reduced pulp chambers 229 therein. The discharge end wall system 240 also preferably includes a number of the open pulp chambers $\mathbf{228}_O$. The open pulp chambers $\mathbf{228}_O$ do not include any plug elements 248.

The plug elements 248 have been found to provide certain advantages. Surprisingly, it has been found that the throughput of the grinding mill 221 of the invention is at least equal to, and may be significantly larger than, the throughput of the prior art grinding mill of equivalent size, in which all of the pulp chambers are open. The reasons for this are unclear. Without wishing to be bound by any theory, it is believed that this is due to a reduction in carryover, which results from the presence of the plug elements in the selected pulp chambers 228', occupying at least a predetermined portion of each of the selected pulp chambers 228'.

In the prior art, "carryover" (described above) is believed to be a result of allowing insufficient time (i.e., during approximately one-half of the total time needed for one rotation of the discharge wall) for all of the pulp to exit from each of the pulp chambers. Due to the presence of the plug elements 248 in the selected pulp chambers 228', the volume of the pulp that may be received in each of the reduced pulp chambers 229 is reduced (i.e., as compared to the volume receivable in any one of the open pulp chambers $\mathbf{228}_O$), in a proportion based on the size of the plug element 248 relative to the size of the open pulp chamber $\mathbf{228}_O$.

Because the open volume available for receiving the pulp in the selected pulp chamber 228' has been reduced to the volume of the reduced pulp chamber 229, a smaller volume of the pulp is receivable in the reduced pulp chamber 229 than would have been receivable in the selected pulp chamber 228', i.e., before insertion of the pulp element 248. As noted above, in one embodiment, only a certain proportion of the pulp chambers in the discharge end wall assembly are selected to have the plug elements 248 positioned therein. It is believed that, because less pulp is received in the discharge end wall system 240 as it rotates, there is less carryover. Specifically, in the reduced pulp chambers 229, there will be less carryover than in one of the open pulp chambers $\mathbf{228}_O$.

One advantage of this is that the reduced carryover volume (in the reduced pulp chambers 229) means that the elements defining the reduced pulp chamber 229 are subjected to less wear. The net result appears to be that the throughput is not decreased by the introduction of the plug elements, and may increase somewhat, due to the reduced carryover. The foregoing is achieved without a decrease in throughput.

An increase in throughput after the plug elements 248 are installed is surprising. Without wishing to be bound by any theory, it may be that the carryover that, in the absence of any plug elements, often occurs in the pulp chamber may have the effect of hindering the exit of a portion of the pulp that otherwise (i.e., in the absence of carryover) would have successfully exited the open pulp chamber. For example, if the fines of the pulp are "dammed" (and held in the pulp chamber) due to a more coarse portion of the carryover located near the exit from the pulp chamber, then those fines would be able to exit successfully, in the absence of carryover. It is thought that, in this way, a slight decrease in the amount of carryover may result in a slight increase in throughput.

As noted above, the mechanisms controlling the movement of the pulp are not well understood. Another possibility is that, for the same input, the result of inserting the plug element 248 into one or more selected pulp chambers 228' is to cause the portion of the pulp that otherwise would have flowed through the selected pulp chambers 228' to flow instead through the open pulp chambers $\mathbf{228}_O$. This portion of the pulp, which is effectively redirected from the selected pulp chambers 228', is thus added to the pulp that would otherwise have flowed into and at least partially out of the open pulp chambers, i.e., in the absence of the plug elements 248 in the system 240. Accordingly, in the discharge end wall system 240, the amount of the pulp flowing through the open pulp chambers $\mathbf{228}_O$ is increased, if compared to the flow of the pulp through each pulp chamber in the prior art grinding mill.

It may be that increasing the amount of the pulp that is located in each open pulp chamber $\mathbf{228}_O$ increases the overall throughput of the pulp through the grinding mill 221. However, what might cause this improvement is not clear at this time. It may be that, when the pulp flows through the open pulp chambers $\mathbf{228}_O$, the friction between the particles of the pulp therein tends to cause the pulp to move together, so that the pulp tends to exit the open pulp chamber $\mathbf{228}_O$ en masse. In short, in the discharge end wall system 240 of the invention, it may be that the pulp that flows into the open pulp chambers $\mathbf{228}_O$ is packed into them more tightly than in the prior art, but not so tightly that the flow of the pulp through the open pulp chambers $228_O$ (and in particular, exit therefrom) is thereby impeded. It may be that the carryover in the open pulp chambers is somewhat less, as a result. As noted above, it is believed that the carryover in the reduced pulp chamber is also much reduced at the same time, as described above.

Figure 2D:
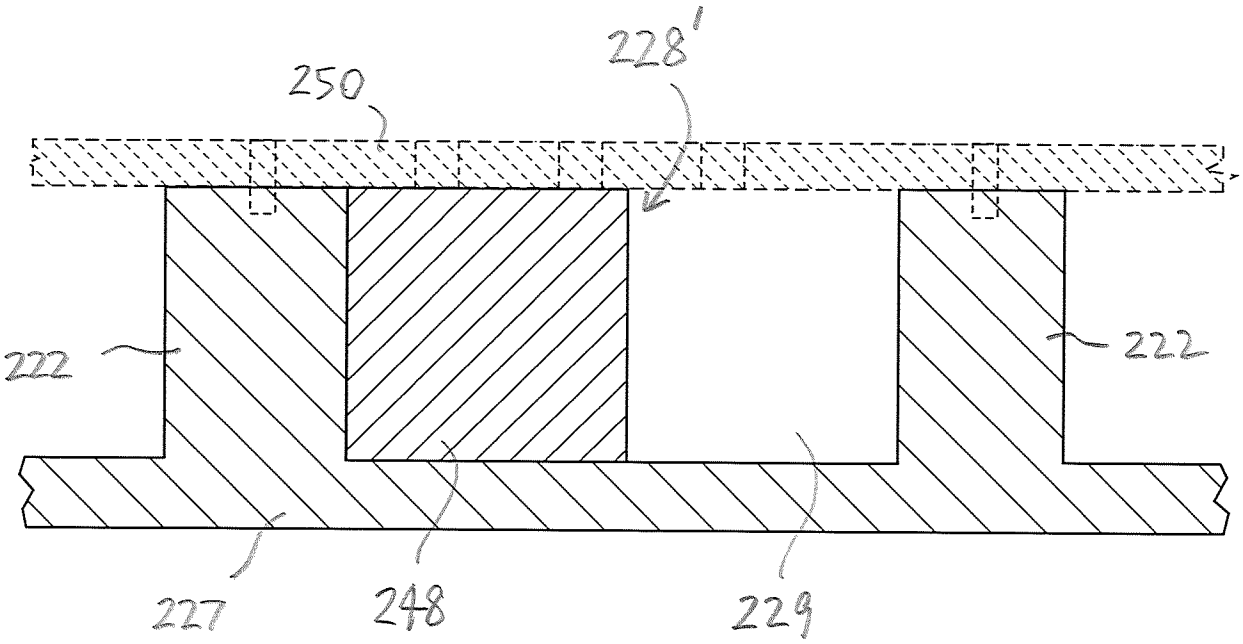
FIG. 2D is a cross-section of one of the partially occupied pulp chambers of the discharge wall assembly of FIG. 2A, drawn at a larger scale.

It will be understood that the plug element 248 may be in any suitable form or configuration. An embodiment of the plug element 248, positioned in a predetermined portion of the selected pulp chamber 228', is illustrated in FIGS. 2B and 2D. As illustrated in FIGS. 2B and 2D, in one embodiment, the plug element 248 preferably occupies approximately one-half of the volume of an outer portion of the selected pulp chamber 228'. The configuration illustrated in FIGS. 2A-2D is also illustrated in FIG. 3A.

In FIG. 3A, the plug element (identified for convenience by reference character A248 in FIG. 3A) that is located in the selected pulp chamber identified for convenience in FIG. 3A by reference character A228' is cross-hatched, so that the extent of the plug element A248 can be seen. As illustrated in FIG. 3A, the pulp chamber A228' has an overall length 252, and includes an inner portion 254 and an outer portion 256. The outer portion 256 of the selected pulp chamber 228' is partially occupied by the plug element A248 (FIG. 3A).

In the embodiment illustrated in FIG. 3A, the plug element has a width "W" and a length "L". The width "W" is approximately one-half of the total width "TW" of the selected pulp chamber 228', at the outer perimeter wall 226 of the mill shell 223. The length "L" of the plug element only extends along the outer portion 256 of the pulp chamber, i.e., in this embodiment, the plug element does not extend into the inner portion of the selected pulp chamber 228'. As will be described, other versions of the plug element may alternatively be utilized.

It will be understood that the grate and the blind plate that are normally positioned to cover the pulp chamber A228' (i.e., when the grinding mill is in use) are omitted from FIGS. 2A and 3A, to simplify the illustrations. It will also be understood that the outer portion 256 of the pulp chamber A228' is covered by the grate 250 and the inner portion 254 is covered by the blind plate. Similarly, the outer portions of the other pulp chambers (both open and selected) are covered by discharge grates respectively, and the inner portions thereof are covered by blind plates.

When a particular open pulp chamber $228_O$ or selected pulp chamber 228' is at least immersed in the charge, the pulp flows through the discharge plate into that open, unoccupied pulp chamber $228_O$ or into the reduced pulp chamber 229 (as the case may be) under the influence of gravity, to the extent that at least a part of the pulp chamber is located below a top surface "S" of the charge "CH" (FIGS. 2A, 2C). For the purposes hereof, the pulp chamber is said to be in an "intake condition" while it is at least partially immersed in the charge, and the pulp is able to flow into that pulp chamber under the influence of gravity. Similarly, for the purposes hereof, while the pulp chamber is at least partially located above the top surface "S" of the charge, and therefore located so that the pulp therein may flow to the central hole 224 and thus exit the grinding mill, the pulp chamber is said to be in a "discharge condition".

Accordingly, it can be seen in FIGS. 2A-3A that, when one of the selected pulp chambers 228' is in the intake condition thereof, the pulp flows through the discharge grate into the reduced pulp chamber 229 thereof. When one of the selected pulp chambers 228' is in the discharge condition thereof, the pulp located in the reduced pulp chamber 229 thereof exits the reduced pulp chamber 229, and flows to the central hole 224 and subsequently exits the grinding mill.

In FIGS. 2A and 3A, the discharge end wall system 240 is illustrated as rotating in a counter-clockwise rotation. Accordingly, and as can be seen in FIG. 2A, any particular open pulp chamber $228_O$ or selected chamber 228' is generally in the discharge condition while the pulp chamber is moved from approximately the three o'clock position to approximately the nine o'clock position.

Those skilled in the art would appreciate that in each rotation, each of the pulp chambers $228_O$, 228' may be very briefly positioned between the intake and discharge conditions, so that the charge flows neither into, nor out of, the pulp chamber $228_O$, 228'. The pulp chamber $228_O$, 228' is between the intake and the discharge conditions when it is approximately at the three o'clock position and approximately at the nine o'clock position, subject to the amount of the charge in the grinding mill.

Those skilled in the art also would appreciate that the mill shell may, alternatively, be rotated in a clockwise direction. In the drawings, the mill shell is illustrated only as rotating in the counter-clockwise direction for clarity of illustration.

It will be understood that the optimum proportion of the pulp chambers in the discharge wall assembly that are the selected (i.e., occupied) pulp chambers 228' may vary. For example, in one embodiment, the open pulp chambers $228_O$ in the discharge end wall assembly 242 preferably include three quarters of the total number of pulp chambers therein. That is, in one embodiment of the discharge end wall system 240, one-quarter of the pulp chambers in the discharge wall assembly 242 are the selected pulp chambers 228', that are at least partially occupied by the plug elements 248 respectively.

Those skilled in the art would appreciate that a proportion of the pulp chambers that include the open pulp chambers preferably is selected for maximizing throughput of the pulp through the discharge end wall assembly 242. As a practical matter, it is believed that the optimum proportions for any particular grinding mill may best be determined by trial and error, in view of the large number of inter-related factors that would need to be considered, if attempting to calculate the optimum proportion of open pulp chambers.

The plug element 248 may include any suitable material. For example, the plug element 248 may be made of concrete.

As can be seen, e.g., in FIG. 2C, the invention preferably includes the grinding mill 221. The grinding mill 221 preferably includes the mill shell 223 and the discharge end wall system 240. The system 240 is mounted on the discharge end wall 227.

The discharge end wall system 240 of the invention may be configured in an existing (prior art) grinding mill, e.g., a grinding mill of the prior art such as that illustrated in FIGS. 1A-1E. In order to retrofit the system 240 of the invention into a conventional grinding mill, the discharge grates preferably are first removed. Next, the size and shape of the plug element is to be determined. Next, the optimum number of the selected pulp chambers for the embodiment of the plug element that is to be used is determined. The pulp elements 248 that are selected are then located in the selected pulp chambers 228'. Those skilled in the art would appreciate that the plug elements 248 may be secured in the selected pulp chambers 228' using any suitable means therefor.

It will be understood that the design process, generally outlined above, may be iterative in nature, i.e., after the plug element's size and shape are initially determined and the optimum number of selected pulp chambers is determined based on that form of the plug element, it may be prudent to amend the design of the plug element, and then reconsider the number of selected pulp chambers. This process may be repeated until satisfactory results are obtained that permit the design to be finalized.

As noted above, the form of the plug element that is positioned in the selected pulp chamber 228' may be any suitable size or shape. In FIG. 3A, for example, the plug element 248 has a width "W" at the mill shell wall that is approximately one-half of the total width "TW" of the selected pulp chamber 228' at the outer perimeter wall 226 of the mill shell 223. In the embodiment of the system 240 illustrated in FIG. 3A, the plug element 248 also occupies only part of the outer portion 256 of the selected pulp chamber 228', and does not occupy part of the inner portion 254 of the selected pulp chamber 228'.

Figure 3B:
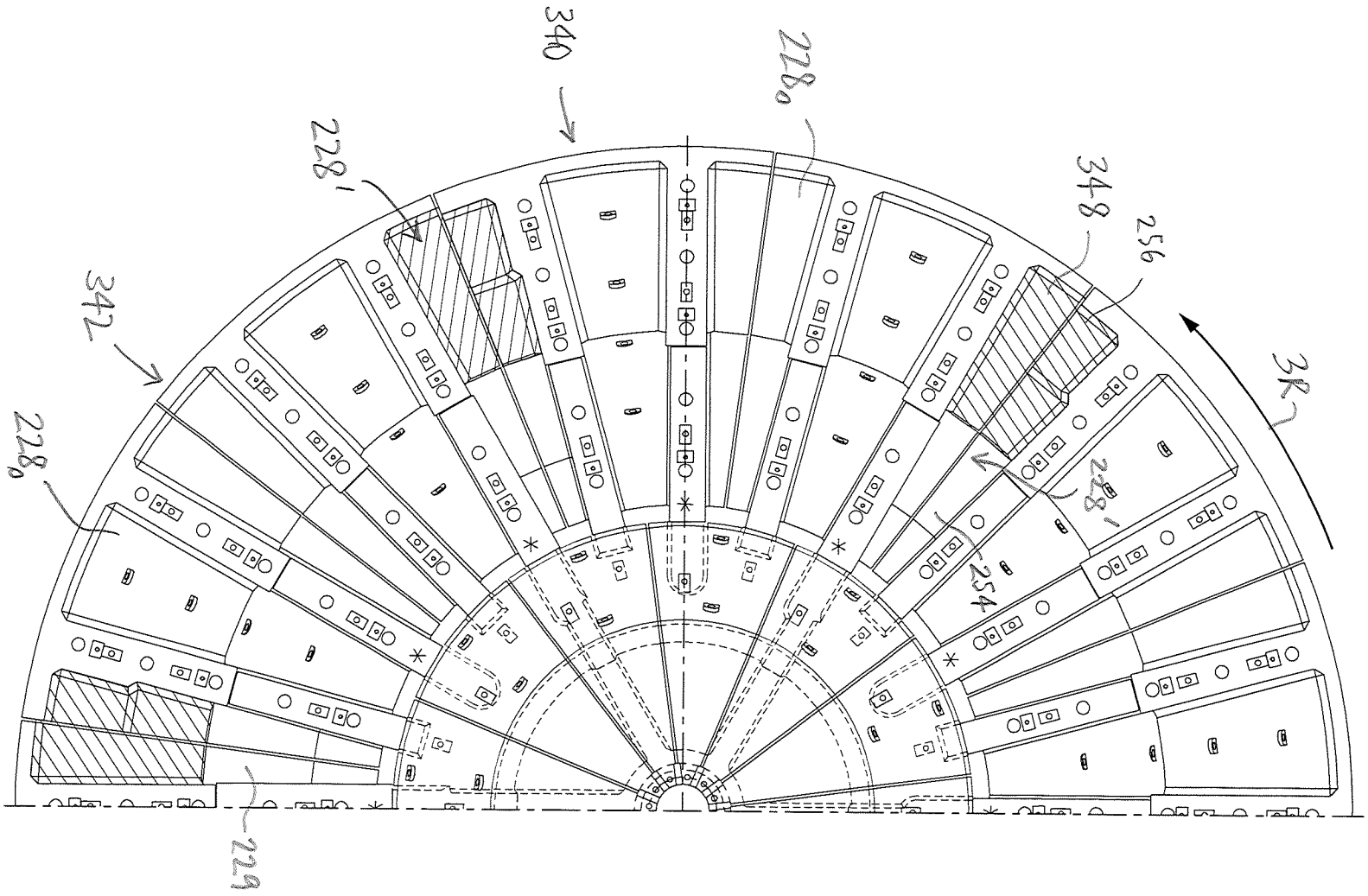
FIG. 3B is a portion of an alternative embodiment of the discharge wall assembly of the invention.

An alternative embodiment of the plug element 348 is illustrated in FIG. 3B, included in another embodiment of the discharge end wall system 340 of the invention. The discharge end wall system 340 includes the discharge end wall assembly 342.

In FIG. 3B, the outer portion 256 of the selected pulp chamber 228' is occupied by the plug element 348. For clarity of illustration, the plug elements 348 are marked with cross-hatching in FIG. 3B. The plug elements 348 occupy the outer portions 256 of the selected pulp chambers 228', but do not extend into the inner portions 254 of the selected pulp chambers 228'.

It will be understood that the optimum proportion of the pulp chambers in the discharge wall assembly 342 that are the selected (i.e., occupied) pulp chambers 228' may vary. For example, in one embodiment, the open pulp chambers $\mathbf{228}_O$ in the discharge end wall assembly 342 preferably include three quarters of the total number of pulp chambers therein. That is, in one embodiment, one quarter of the pulp chambers in the discharge wall assembly are the selected pulp chambers 228', that are at least partially occupied by the plug elements 348 respectively.

Those skilled in the art would appreciate that the proportion of the pulp chambers of the total in any discharge end wall assembly would depend on a number of parameters. As noted above, due to the large number of parameters involved and the interrelated relationships therebetween, the optimum configuration of the plug element, and the optimum proportion of the selected pulp chambers in which the plug element is received, is best determined via trial and error.

The discharge end wall system 340 is rotated in the direction indicated by arrow "3R" (FIG. 3B). It will be understood that discharge grates and blind plates are omitted from FIG. 3B, for clarity of illustration.

As the discharge end wall system 340 is rotated about the grinding mill's axis, the pulp chambers are respectively moved between intake conditions and discharge conditions thereof. When one of the selected pulp chambers 228' is in the intake condition, virtually no pulp flows into the reduced pulp chamber 229, because the reduced pulp chamber 229 in this embodiment is the inner portion 254 of the selected pulp chamber 228', which located substantially entirely behind a blind plate (not shown in FIG. 3B).

Figure 3C:
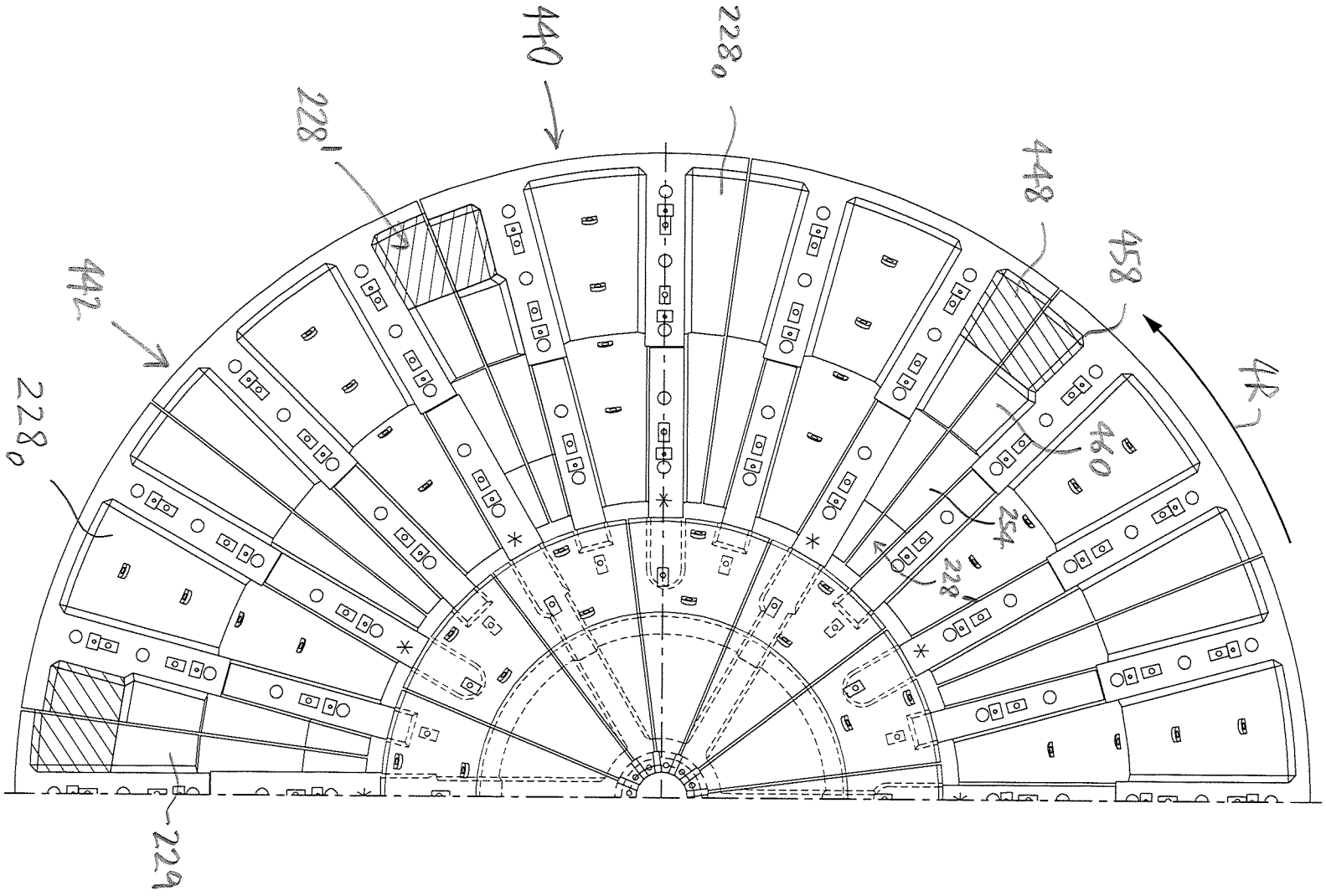
FIG. 3C is a portion of another alternative embodiment of the discharge wall of the invention.

An alternative embodiment of the plug element 448 is illustrated in FIG. 3C, included in another embodiment of the discharge end wall system 440 of the invention. The discharge end wall system 440 includes a discharge end wall assembly 442.

In FIG. 3C, a selected part 458 of the outer portion 256 of the selected pulp chamber 228' is occupied by the plug element 448. For clarity of illustration, the plug elements 448 are marked with cross-hatching in FIG. 3C. The plug elements 448 occupy the parts 458 of the outer portions 256 of the selected pulp chambers 228', but do not extend into the inner portions 254 of the selected pulp chambers 228'. Preferably, a part 460 of the outer portion 256 remains unoccupied, or open (FIG. 3C). Accordingly, it can be seen in FIG. 3C that, in this embodiment, the reduced pulp chamber 229 includes the inner portion 254 of the selected pulp chamber 228' and the part 460 of the outer portion 256.

It will be understood that the optimum proportion of the pulp chambers in the discharge end wall system 440 that are the selected (i.e., occupied) pulp chambers 228' may vary. For example, in one embodiment, the open pulp chambers $\mathbf{228}_O$ in the discharge end wall assembly 442 preferably include three quarters of the total number of pulp chambers therein. That is, in one embodiment, one-quarter of the pulp chambers in the discharge wall assembly are the selected pulp chambers 228', that are at least partially occupied by the plug elements 448 respectively.

Those skilled in the art would appreciate that the proportion of the pulp chambers of the total in any discharge end wall assembly would depend on a number of parameters. As noted above, due to the large number of parameters involved and the interrelated relationships therebetween, the optimum configuration of the plug element, and the optimum proportion of the selected pulp chambers in which the plug element is received, is best determined via trial and error.

The discharge end wall system 440 is rotated in the direction indicated by arrow "4R" (FIG. 3C). It will be understood that discharge grates and blind plates are omitted from FIG. 3C, for clarity of illustration.

As the discharge end wall system 440 is rotated about the grinding mill's axis, the pulp chambers are respectively moved between intake conditions and discharge conditions thereof. The pulp chambers include the open pulp chambers $\mathbf{228}_O$ and the selected pulp chambers 228'. When one of the selected pulp chambers 228' is in the intake condition, pulp flows into the part 460.

Those skilled in the art would appreciate that other configurations of the plug element may be utilized. In addition, although one-quarter of the pulp chambers include plug elements in those embodiments of the discharge end wall system that are illustrated, those skilled in the art would appreciate that other proportions of selected pulp chambers may be utilized, if appropriate.

It will also be appreciated by those skilled in the art that the invention can take many forms, and that such forms are within the scope of the invention as claimed. The scope of the claims should not be limited by the preferred embodiments set forth in the examples, but should be given the broadest interpretation consistent with the description as a whole.

We claim:

1. A grinding mill comprising:

a mill shell comprising a mill shell chamber therein and having an outer perimeter wall partially defining a discharge end wall of the mill shell, rotatable in a direction of rotation to produce a pulp including ore particles and water;

the discharge end wall having a central hole therein through which the pulp exits the mill shell;

a discharge end wall assembly comprising:

a plurality of pulp lifters mounted on the discharge end wall, the pulp lifters being arranged in pairs of adjacent ones of the pulp lifters respectively comprising a leading one of the pulp lifters in the pair and a trailing one of the pulp lifters in the pair relative to the direction of rotation, a trailing edge surface of the leading one of the pulp lifters and a leading edge surface of the trailing one of the pulp lifters partially defining respective pulp chambers therebetween;

at least one plug element located in at least one selected one of the pulp chambers, said at least one plug element being formed to occupy at least a portion of said at least one selected pulp chamber to define at least one reduced pulp chamber therein, the pulp chambers other than said at least one selected pulp chamber comprising a plurality of open pulp chambers, said at least one plug element being sized and located for optimal flow of the pulp through the open pulp chambers and said at least one reduced pulp chamber.

2. The grinding mill according to claim 1 in which said open pulp chambers comprise three quarters of the pulp chambers in the discharge end wall assembly.

3. The grinding mill according to claim 1 in which a proportion of the pulp chambers that comprise the open pulp chambers is selected for maximizing throughput of the pulp through the discharge end wall assembly.

4. A method of minimizing carryover of a pulp including ore particles and water in a discharge end wall assembly, the method comprising:

(a) providing at least one plug element, to be positioned in at least a predetermined portion of at least one selected pulp chamber;

(b) selecting said at least one selected pulp chamber, for receiving said at least one plug element; and (c) installing said at least one plug element in said at least one selected pulp chamber, to occupy the predetermined portion of said at least one selected pulp chamber.

5. A method of mitigating wear in a discharge end wall assembly comprising a discharge end wall of a mill shell, the mill shell being rotatable about an axis of rotation in a direction of rotation and defining a mill shell chamber therein in which a pulp including ore particles and water is produced by comminution, the discharge end wall assembly comprising a plurality of pulp chambers at least partially radially located relative to the axis of rotation, the method comprising the steps of:

(a) providing at least one plug element, to be positioned in at least one selected pulp chamber, for occupying at least a portion of said at least one selected pulp chamber;

(b) determining a proportion of the pulp chambers in the discharge end wall assembly that comprise a plurality of open pulp chambers, the proportion being determined for maximizing throughput of the pulp through the discharge end wall assembly; and (c) positioning said at least one plug element in said at least one selected pulp chamber, to define at least one reduced pulp chamber therein, wherein the pulp flows through the open pulp chambers and said at least one reduced pulp chamber as the discharge end wall assembly rotates.

* * * * *